US005320435A

United States Patent [19]

Warwick et al.

[11] Patent Number: 5,320,435

[45] Date of Patent: Jun. 14, 1994

[54] DIRECT SOLENOID DRIVE IMPRINTING MECHANISM

[75] Inventors: Dennis J. Warwick, Richfield; Ronald B. Howes, Jr., Minneapolis, both of Minn.

[73] Assignee: DataCard Corporation, Minneapolis, Minn.

[21] Appl. No.: 949,768

[22] Filed: Sep. 22, 1992

Related U.S. Application Data

[63] Continuation of Ser. No. 830,993, Feb. 5, 1992, abandoned, which is a continuation of Ser. No. 607,853, Nov. 1, 1990, abandoned, which is a continuation of Ser. No. 204,499, Jun. 9, 1988, abandoned.

[51] Int. Cl.[5] ..... B41J 1/54; B41J 9/48

[52] U.S. Cl. ..... 400/134; 400/157.2; 400/166

[58] Field of Search ..... 400/134, 134.1, 129, 400/134.2, 157.3, 166, 385, 386, 388, 389, 390, 391, 392, 393, 391.1, 391.2, 391.3, 391.4; 101/3.1, 18, 93.29, 93.30, 93.31, 93.32, 93.33, 93.34, 93.48, 316

[56] References Cited

U.S. PATENT DOCUMENTS

| | | | |
|---|---|---|---|
| 2,779,271 | 1/1957 | Goetz | 101/301 |
| 2,927,676 | 3/1960 | Abbondanza | 400/134.2 |
| 3,001,624 | 9/1961 | Guttel et al. | 400/134.2 |
| 3,306,416 | 2/1967 | Dahlin et al. | 400/134.2 |
| 3,712,212 | 1/1973 | Beery | 400/157.3 X |
| 3,900,094 | 8/1975 | Larsen et al. | 400/124 |
| 3,998,153 | 12/1976 | Erhardt et al. | 101/93.48 |
| 4,022,311 | 5/1977 | Krull | 101/93.34 |
| 4,084,502 | 4/1978 | Heyrand et al. | 101/93.29 |
| 4,203,675 | 5/1980 | Osmera et al. | 101/93.47 |
| 4,220,085 | 9/1980 | Schottle et al. | 101/287 X |
| 4,348,119 | 9/1982 | Carson, Jr. et al. | 400/157.2 |
| 4,378,733 | 4/1983 | Polad et al. | 101/18 |
| 4,407,595 | 10/1983 | Gershnow | 400/212 |
| 4,476,781 | 10/1984 | Kubacki et al. | 101/3 R |
| 4,493,253 | 1/1985 | Vyas | 400/157.3 |
| 4,668,112 | 5/1987 | Gabor et al. | 400/157.3 |
| 4,678,355 | 7/1987 | Gabor et al. | 101/93.29 |

FOREIGN PATENT DOCUMENTS

| | | | |
|---|---|---|---|
| 3330563 | 3/1985 | Fed. Rep. of Germany | 400/134 |
| 1395444 | 5/1975 | United Kingdom | 400/134.2 |

OTHER PUBLICATIONS

English translation of German Patent No. 3330563 (Schottle).

*Primary Examiner*—David A. Wiecking

*Attorney, Agent, or Firm*—Merchant, Gould, Smith, Edell, Welter & Schmidt

[57] ABSTRACT

An apparatus for embossing sheet material by applying pressure to punch and die members positioned on both sides of the sheet material using force developed by one or more solenoids to force the punch and die members together to apply an imprinting force. In order to reduce the impact force, noise and wear on the mechanical parts, the solenoid may be energized in two separate steps, the first to move the punch and die members into contact with the surface of the card and the second to apply the embossing force to the punch and die members. Both rotary and linear solenoids may be used with differing coupling linkages in various embodiments of the embossing mechanism.

23 Claims, 5 Drawing Sheets

DIRECT SOLENOID DRIVE IMPRINTING MECHANISM

This is a continuation, of application Ser. No. 07/830,993, filed on Feb. 5, 1992, entitled DIRECT SOLENOID DRIVE IMPRINTING MECHANISM, now abandoned which is a continuation of application Ser. No. 07/607,853, filed Nov. 1, 1990, now abandoned, which is a continuation of application Ser. No. 07/204,499, filed on Jun. 9, 1988, now abandoned.

BACKGROUND OF THE INVENTION

1. Field of the Invention

The present invention relates to an embossing system and more particularly to a solenoid driven embossing mechanism for embossing information onto a common credit card.

Automated embossing systems have found wide acceptance in the field. Two such systems are disclosed in U.S. Pat. Nos. RE 27,809 to Drillick and U.S. Pat. No. 3,820,454 to Hencley et al and U. S. Pat. No. 3,820,455.

U.S. Pat. Nos. 4,271,012, 4,180,338 and 4,088,216 all show a system utilizing a pair of embossing heads in a card transport mechanism for rapidly positioning a card to receive characters from punch and die members carried by punch and die wheels. The characters are applied to various embossing locations on the surface of a card. The application of the embossing forces to the punch and die members is, in all of the systems shown in the patents listed above, by a motorized cam driven, continuously oscillating bail arm mechanism for mechanically driving the punch and die members. Such systems are mechanically complex and quite heavy because of the necessity of providing extremely strong mechanical structures for mechanically developing and coupling the embossing forces to the punch and die elements. Such prior art structures are not particularly helpful for use in simple and common lower volume applications where machines having reduced physical size and weight and lower cost are particularly necessary.

SUMMARY OF THE INVENTION

Accordingly, it is an object of this invention to provide apparatus for embossing sheet material which provides the embossing function without the use of motor driven cams and continuously oscillating bail arms to drive the punch and die elements. The apparatus is of reduced size and weight relative to what has been previously available.

Another object of the invention is to provide apparatus for embossing sheet material and which includes a plurality of cooperating punches and dies inserted in slots positioned about circumference of punch and die wheels rotatable in synchronism with each other to permit positioning of a selected punch and die pair on both sides of sheet material positioned in an emboss location and improved embossing pressure applying mechanism. The mechanism includes at least one solenoid mechanism mounted on the frame and constructed and arranged for effecting linear movement of punch and die members along an embossing axis when the solenoid is energized from a first position to a second position by application of a suitable voltage; linkage means coupled to the shaft of each of the solenoid means and including drive pin means for imparting motion, along the embossing axis, of the solenoid shaft to an embossing element, the linkage means also including spring restraining means for retaining the solenoid shaft in the first unactuated condition; and driver means for applying voltage for energizing the solenoid means to apply a selected character to sheet material positioned in the embossing area.

DETAILED DESCRIPTION OF THE PREFERRED EMBODIMENTS

Figures 1, 2, 3, 4, 5, 6:
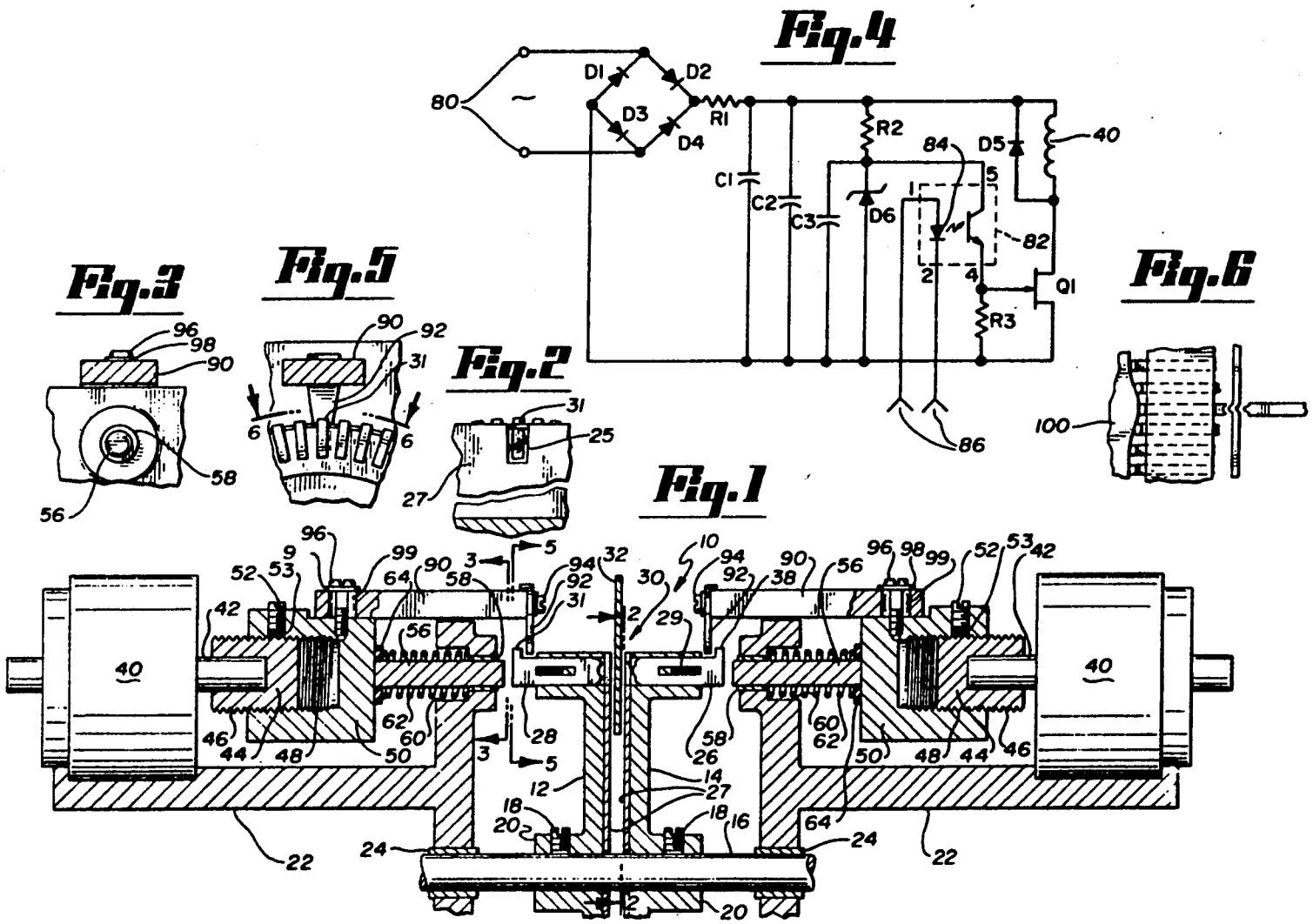
FIG. 1 is a sectional view of the important elements of the embossing mechanism shown in section taken vertically through the rotational axis of the printwheel with some elements not sectioned for illustrative purposes.
FIG. 2 is a sectional view taken along the line 2—2 of FIG. 1.
FIG. 3 is a sectional view taken along line 3—3 of FIG. 1.
FIG. 4 is a schematic electrical diagram of the solenoid drive circuitry.
FIG. 5 is a sectional view taken along the line 5—5 of FIG. 1.
FIG. 6 is a fragmentary sectional view of an alternate embodiment of an embossing mechanism utilizing only a single solenoid and is the view that would be seen viewing along the line 6—6 of FIG. 5.

In the several embodiments of the invention shown, parts common to the several embodiments may be identified by the same reference characters.

FIG. 1 shows the important elements of one of the preferred embodiments of the direct solenoid drive embossing mechanism 10. The punch and die embossing elements of the basic embossing system are similar to what is shown in U.S. Pat. No. 4,271,012 and U.S. Pat. No. 4,519,600, both of which are assigned to the assignee of the prevent invention. In those and other prior art embossing mechanisms, a pair of type element wheels 12 and 14 are mounted on a common shaft 16 and secured by set screws 18 located in hubs 20. (Whenever reference numerals are used throughout the specification, they refer to structures in the present invention.) Of course, use of a single shaft 16 is not necessary since other means can be utilized to synchronize the rotation of wheels 12 and 14, even if they are mounted on separate but coaxial shafts. Shaft 16 is supported on frame 22 by bearings 24. Shaft 16 is driven by positioning mechanisms as shown in U.S. Pat. No. 4,271,012 so that appropriate pairs of punch elements, such as 26, on wheel 14 and die elements, such as 28, on wheel 12 are positioned for embossing. FIG. 2 shows the embossing punch 26 aligned with an aperture 25 in a stationary guide plate 27. Guide plates 27 define an embossing area 30 between them.

A suitable card or sheet material 32 is positioned with the area to be imprinted located in the embossing area 30. The card handling mechanism shown in U.S. Pat. Nos. 4,271,012 or 4,519,600, for example, provides a suitable mechanism for positioning card 32 and moving it through embossing area to receive a series of embossed characters from punch and die members 26 and 28 and other selected punch and die members carried by wheels 14 and 12.

In prior patents such as U.S. Pat. Nos. 4,271,012 and 4,591,600, the embossing pressure was applied to punch and die members 26 and 28 using a complex mechanical mechanism driven by a pair of oscillating continuously motor driven bail arms utilizing a complex mechanical linkage to bring force from the movement of the continuously oscillating bail arms to the punch and die members. In the preferred embodiment of the present invention, a variety of greatly simplified solenoid actuated drive mechanisms have been devised to eliminate the use of the motor cam and continuously driven oscillating bail arms and the complex mechanical linkages, relying instead upon the considerable embossing forces which can be developed by an improved linear solenoid.

In the preferred embodiments shown in FIGS. 1 through 6, linear solenoids 40 are each secured to frame 22 with their shafts 42 projecting and aligned with the axis of linear movement of punch and die members 26 and 28 into and away from embossing area 30. Suitable linear solenoids 40 are manufactured by Ledex Inc., 801 Scholz Drive, Vandalia, Ohio 45377, and described as axial solenoids Part Nos. 189987 or 187790.

In FIG. 1, shaft 42 is secured in an inner sleeve 44 which may be adhesively secured to shaft 42 using a set screw, by shrink fit or by the use of a suitable adhesive. Alternatively, shaft 42 can be threaded to threadably engage inner threads on outer sleeve 50. Sleeve 44 has a set of outer threads 46 which engage corresponding threads 48 on the inner wall of outer sleeve 50. Outer sleeve 50 is secured to inner sleeve 44 using a set screw 52 which can be tightened to apply pressure to the threads of inner sleeve 44. In order to protect the threads 46 of inner sleeve 44, a plastic plug 53 is inserted in the hole in outer sleeve 50 before set screw 52 is inserted, thereby providing a resilient locking action which is not likely to damage outer threads 46 of inner sleeve 44. Outer sleeve 50 has a hardened driver pin 56 mounted in front of it which is slidably supported in a plain bearing 58 inserted in an aperture 60 of frame 22 as can be seen in FIGS. 1 and 2. Drive pin 56 is formed of a suitable hardened material to withstand the repeated impacts with punch and die members 26 and 28 as the embossing mechanism is operated.

A restraining spring 62 is seated in aperture 60 of frame 22 so that one end bears upon the frame 22 while the other end bears upon a grip ring 64, which is attached to drive pin 56. Alternatively, drive pin 56 can have a projecting shoulder or head, rather than ring 64, to hold spring 62. Spring 62 is a compression spring which biases the linkage elements and solenoid shaft 42 into a rest position so that drive pin 56 is normally spaced from the head of punch and die members 26 and 28, thereby permitting wheels 12 and 14 to be rotated without interference to position selected punch and die sets for embossing. The restraining force of spring 62 is preferably kept at as low a level as possible to facilitate the adjusting of the solenoid current to minimize impact noise as described in more detail below.

When the selected pair of punch and die elements 26 and 28 are positioned in the embossing area, solenoid 40 is actuated to drive shaft 42 toward the embossing area, thereby moving inner sleeve 44, outer sleeve 50 and drive pin 56 toward the embossing area, striking punch or die member 26 or 28 and forcing it into engagement with card 32 in embossing area 30. If sufficient travel of shaft 42 occurs and a sufficient force is developed, the card will be embossed with the character defined by the punch and die members 26 and 28.

An important advantage of the direct solenoid driven embossing mechanisms of this invention is that there need be no long delay between the time that the selected embossing area of the card is in position and the application of the punch and die to the card. In the prior art systems using continuously rotating bail arms, there is an inherent delay between the positioning of the card and the time when the bail arms are in the proper position to apply the embossing force. In such systems, each character is delayed by about one-half cam rotation for each character. In the present system, solenoid 40 can be energized as soon as the card is in position to receive the character, and a shorter time is required to emboss a series of characters.

Because solenoid 40, if actuated with a single electrical drive pulse, provides a very sharp impact between driver pin 56 and punch or die element 26 or 28, in addition to the noise as the solenoid reaches its internal stop, an extremely noisy embossing operation occurs, unless modifications are made to the solenoid drive. This is due in part to the fact that the solenoid armature and linkage have a considerable mass which is moving at a relatively high speed at the time that it overcomes the compression force of spring 62 and impacts the surface of card 32.

In order to prevent noisy operation, it has been determined that the solenoid 40 should be energized in two stages. In the first stage of energization, sufficient voltage is applied to the solenoid for sufficient time merely to allow drive pin 56 to engage punch or die member 26 or 28 and bring it into contact with the surface of card 32. After punch 26 and die 28 have been brought into contact with card 32, solenoid 40 is energized again for a longer time interval to apply force to the punch and die member to emboss the card. Because punch and die 26 and 28 are already in contact with card 32 when the embossing force is applied, the loud impact noise of the printing elements striking the card is avoided and the pressure applying step necessary for completion of the embossing operation occurs with little noise. The impact of the movable solenoid shaft 42 against the internal stop is also reduced because the control of the energization pulse reduces the velocity of the moving parts without reducing the embossing force. Using an extremely short interval for the first voltage application to solenoid 40 results in a much lower impact force between the face of the type element and card 32 and therefore reduces the total noise of the operation without degrading the quality of the embossing. It also may allow for longer life of the mechanical embossing elements.

Application of the embossing command voltage in two parts to accomplish quiet embossing can be performed by the control circuitry of the embossing machine. After the proper punch and die pair are in the emboss area 30 and card 32 is correctly positioned, the emboss command voltage may be applied to solenoid 40. It has been found that optimum operation for typical plastic card stock occurs when the initial voltage application lasts for approximately 4 msecs. followed by a period when no voltage is applied for approximately 5 msecs. and then the voltage is applied for a further 75 to 100 msecs. to complete the embossing operation. Approximately 200 msec. is required to return the elements to their rest position at the completion of the embossing operation.

A suitable circuit for driving solenoid 40 in response to a two part command signal is shown in FIG. 4. In that Figure, a full-wave rectifier comprised of diodes D1 through D4 rectifies the AC voltage applied to input terminals 80. The full wave rectified DC voltage is filtered by resistor R1 and capacitors C1 and C2. The voltage is then further filtered by resistor R2 and capacitor C3 and limited to zener diode D6 and applied to the collector of a photocoupled transistor 82 which in turn controls the flow of current to resistor R3 which develops the voltage for controlling field effect transistor Q1 which provides the power switching action for the winding of solenoid 40. A flyback diode D5 suppresses the inductive voltage transient when switch Q1 is turned off with a strong current flowing in solenoid winding 40.

The circuit in FIG. 4 operates by turning the NPN transistor of photocoupled transistor 82 ON when light is received from photodiode 84 in the photoconductor package in response to actuation of LED 84 by the presence of a command voltage on terminals 86. The input to input terminals 86 which can be provided by an output port of the computer used to control the operations of embossing mechanism 10 or by any other suitable analog or digital circuitry which can provide the desired short initial pulse to allow the type elements to move into contact with the card surface with minimum impact force and then to apply the full embossing force after the type elements are in contact with the surface of the card, thereby minimizing the noise created by a full force impact of the type elements into the surface of a card.

The matching of the command signal for the solenoid can also be used to vary the embossing force and to form smaller characters in a short interval, while larger characters receive more force and a longer cycle time. With the solenoid of the preferred embodiment, nearly 50 msec. is required to allow the magnetic field to fully build up. Since the embossing force is directly proportional to the field strength, the full 50 msec. is required to emboss characters like a capital "8" which requires about 250 pounds of embossing force. A simple "." requires between 50 and 100 pounds of embossing force. That force can be built up in about 20 msec. The embossing forces can be matched to the character being embossed by varying the time duration of the excitation to solenoid 40 or by monitoring the current wave shape to solenoid to determine when plunger 42 has stopped moving. The command applied to terminals 86 can have a different length for each character in accordance with stored information in the electronic circuitry (not shown) used to select the characters and to otherwise control the operation of the machine.

Between embossing operations, it is of course necessary to move drive pin 56 away from the type elements and to make certain that the type elements have been retracted from the face of card 32. The type elements may each be provided with return springs as shown in FIG. 8C of U.S. Pat. No. 4,271,012, to assist them in returning to their rest position as shown in FIG. 1, separated from the surface of card 32. In FIG. 1, return springs 29 can be mounted in each type element to provide a spring for returning the type element to the rest position.

In order to provide a more positive return force, a retractor plate 90 is attached to a retractor arm 92 using an attachment screw 94. Retractor arm 92 is in turn secured to outer sleeve 50 using a screw 96 and washer 98. Retractor hooks the flange 31 of the punch 26 or die 28 and positively retracts that element from the embossing position as solenoid 40 is deenergized. The engagement of the retractor and die element 28 is shown in FIG. 5. An oversized slot 99 in retractor arm 92 permits adjusting the extension of retractor plate 90. Use of retractor plate 90 may obviate the need for the individual return springs 29. A reverse current could also be applied to solenoid 40 to allow for a quicker return of plunger 42 thereby yielding faster cycle time.

For each of the embodiments shown, it will be seen that it is not necessary for adequate embossing to utilize two solenoids 40 as shown in FIG. 1. It has been found that adequate operation at slower speeds occurs if one of the two solenoids 40 is replaced by a cam 100, as shown in FIG. 6, the protruding surface of which forces one of the two cooperating embossing elements 26 or 28 toward embossing area 30 and card 32 while the other element is driven by solenoid 40 in the manner shown in FIG. 1. Cam surface 100 which replaces one of the solenoids 40 shown in FIG. 1 forces each of the type elements 26 or 28 toward card 32 as shaft 16 is rotated to move the type elements on the type wheel past the cam surface.

Figure 7:
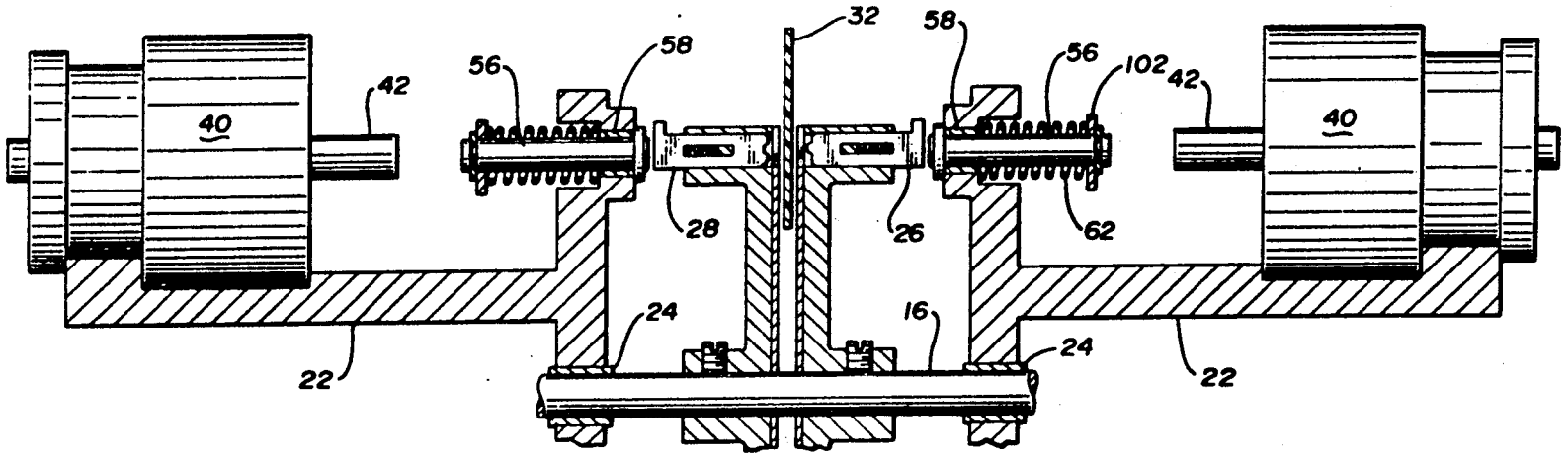
FIG. 7 is a sectional view of another embodiment of the embossing mechanism with the section taken in the same manner as FIG. 1.

FIG. 7 shows another embodiment of the embossing mechanism utilizing a modified coupling arrangement for linear solenoids aligned with the axis of movement of the punch and die elements 26 and 28, respectively. In FIG. 7, linear solenoids 40 are long stroke linear solenoids which move shaft 42 a significantly greater distance upon actuation than solenoids 40 shown in FIGS. 1 through 6. In FIG. 7, solenoid plungers 42 are accelerated along the axis of movement of punch and die print elements 26 and 28 when solenoids 40 are actuated. Plungers 42 then strike drive pins 56 which, in turn, are driven against the print elements 26 and 28 to move them into embossing or imprinting contact with card 32. As distinguished from the embodiment shown in FIGS. 1 through 6, the embosser shown in FIG. 7 applies the embossing force during a relatively short time interval with a large embossing force The embossing energy is provided by the kinetic energy of plungers 42 and drive pins 56 as they move against punch and die members 26 and 28. Plungers 42 are accelerated to a relatively high velocity by solenoids 40. Since the amount of energy imparted to print elements 26 and 28 is dependent upon the square of the velocity of the impacting parts, the print elements 26 and 28 are capable of providing a significant embossing force which may be suitable for embossing metal, cards which require more embossing force such as cards 32, for example. Plastic cards can, of course, also be embossed.

After the embossing force is applied to punch and die members 26 and 28, a restoring force is provided by spring 62 which bears upon frame 22 at one end and a retaining clip 102 mounted at the end of drive pin 56 which was struck by plunger 42 to effect the embossing operation. As was the case with the embodiments shown in FIGS. 1 through 6, the embodiment shown in FIG. 7 provides a relatively simple linkage since the solenoids used to generate the embossing force provide their linear output force along the axis of movement of embossing elements 26 and 28.

Figure 8:
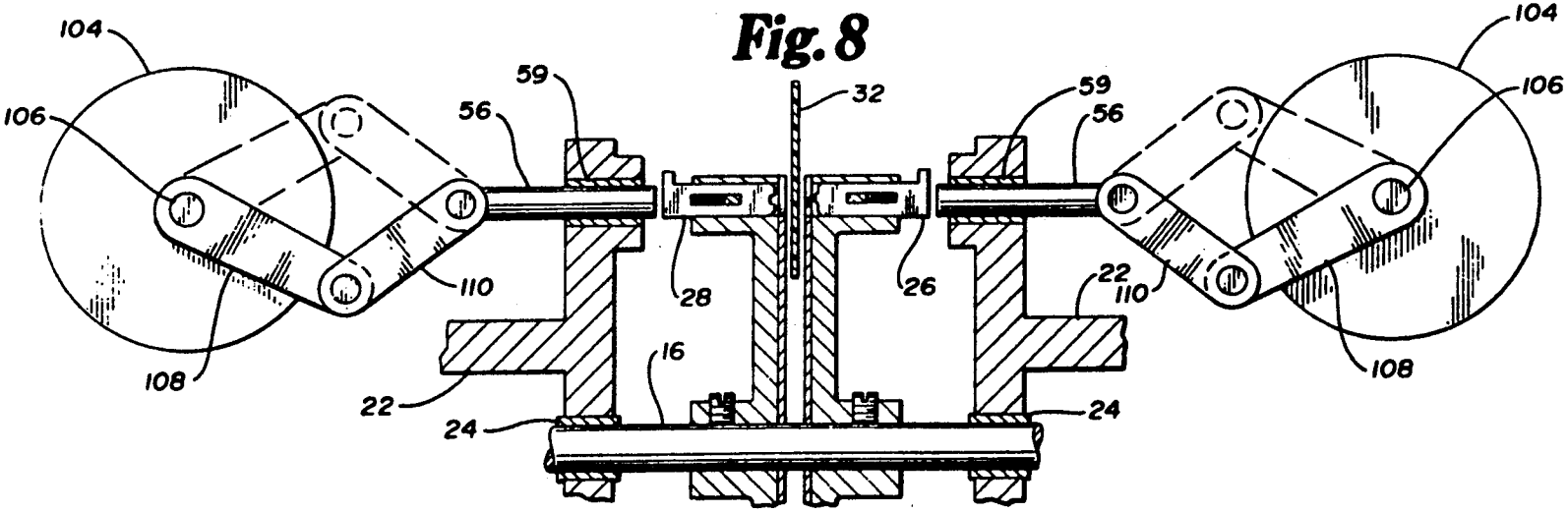
FIG. 8 is a sectional view of yet another embodiment of the embossing mechanism with the section taken in the same manner as FIGS. 1 and 7.

FIG. 8 shows another form of embossing mechanism utilizing rotary solenoids 104, rather than linear solenoids 40, to generate the embossing forces. Solenoid 104 has an output shaft 106 which is rotated upon actuation of the solenoid. Shaft 106 drives a link 108 which is pivotally connected to a further link 110 which is, in turn, pivotally connected to drive pin 56 which is supported in an oil-lite bearing 59 which defines an aperture through frame 22 for supporting shaft 56 for linear oscillatory motion along the printing axis of punch and die print elements 26 and 28. As shown in FIG. 8, rotation of shaft 106 of rotary solenoids 104 moves the linkage formed of links 108 and 110 from the solid line positions shown in FIG. 8 to the positions shown in phantom outline. As shaft 106 rotates to move the linkage, it can be seen that drive pins 56 are forced into contact with punch and die members 26 and 28, thereby applying a suitable embossing force to those members to form a character on card 32. As distinguished from the structure shown in FIG. 7, the structure shown in FIG. 8 operates relatively quietly because there is no impact between a rapidly moving relatively massive element, such as shaft 42, and drive pin 56. Because the distance between drive pin 56 and punch and die members 26 and 28 is relatively small, there is little acceleration of drive pin 56 before it engages print elements 26 and 28 so the impact noise is held to a minimum. Depending somewhat upon the speed of actuation of solenoids 104, the structure shown in FIG. 8 may apply a somewhat lesser embossing force over a longer time duration than does the impact embosser structure shown in FIG. 7.

In order to drive the structure shown in FIG. 8 from the position shown in dotted outline to the position shown in solid line, it is necessary to have a force applied by rotary solenoids 104 in a direction opposite to that it was applied at the time that they were actuated to initiate the embossing operation. Such a force can be provided by a spring bias arrangement which would return the linkage to the initial position. Although it is less desirable, the embossing operation can be accomplished with a solenoid which is selectively energized between embossing steps and uses spring force to effect the embossing when the energization is removed. The mechanism can alternatively be provided by a double-acting solenoid which, when actuated in the reverse direction, drives from the position shown in dashed outline to the initial position to effectuate a second embossing operation.

Figure 9:
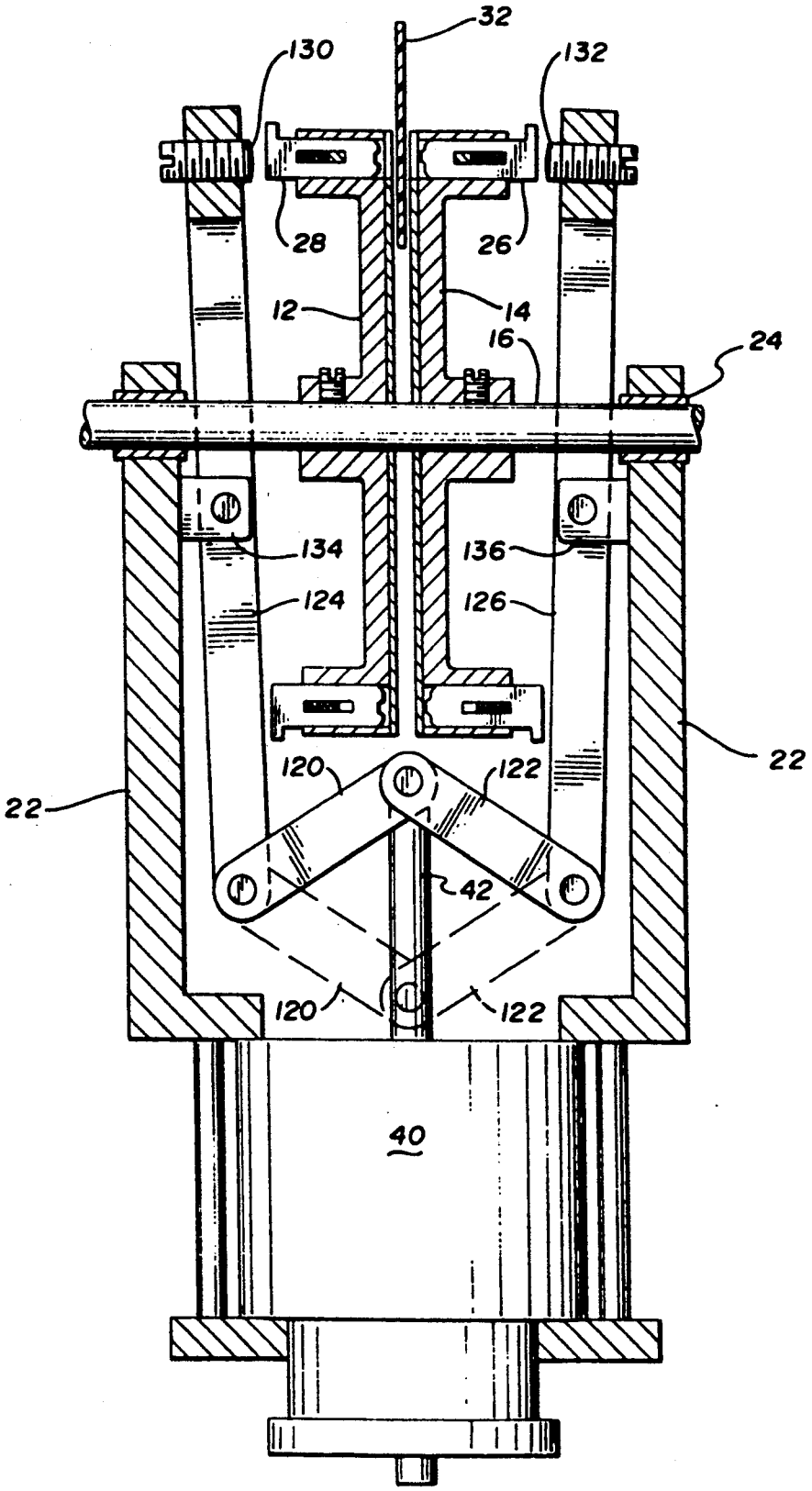
FIG. 9 is a sectional view of a further embodiment of the embossing mechanism with the section taken vertically through the rotational axis of the printwheel.

In FIG. 9, a further embodiment of the solenoid driven embossing mechanism is shown. As was the case with the other forms of the embossing mechanism, the punch and die elements 26 and 28 are mounted in the same manner relative to card 32. A single linear solenoid 40 drives a shaft 42 which is connected to a pair of links 120 and 122 which are in turn pivotally connected at one end to links 120 and 122 and have adjusting screws 130 and 132 inserted in suitable threaded openings at their other ends. Links 124 and 126 are pivotally supported at a location between the ends by suitable clevis and bearing arrangements 134 and 136, respectively. When shaft 42 of solenoid 40 is actuated to retract shaft 42 into the body of solenoid 40, links 120 and 122 move from the position shown in solid lines in FIG. 9 to the position shown in dashed lines, forcing the bottom ends of links 124 and 126 away from the axis of shaft 42 and forcing adjusting screws 130 and 132 into pressure applying contact with punch and die elements 26 and 28 to emboss the surface of card 32. As was the case with the structure shown in FIG. 8, solenoid 40 can either be a double-acting solenoid to apply an embossing force each time shaft 42 moves between the two positions illustrated or, alternatively, solenoid 40 can be single-acting with a biased restoring spring to return shaft 42 to the initial position after an embossing cycle when the printwheels 12 and 14 are positioned so that no punch and die members 26 and 28 are engaged by adjusting screws 130 and 132 during the portion of the cycle when the solenoid returns to its initial position.

Figure 10:
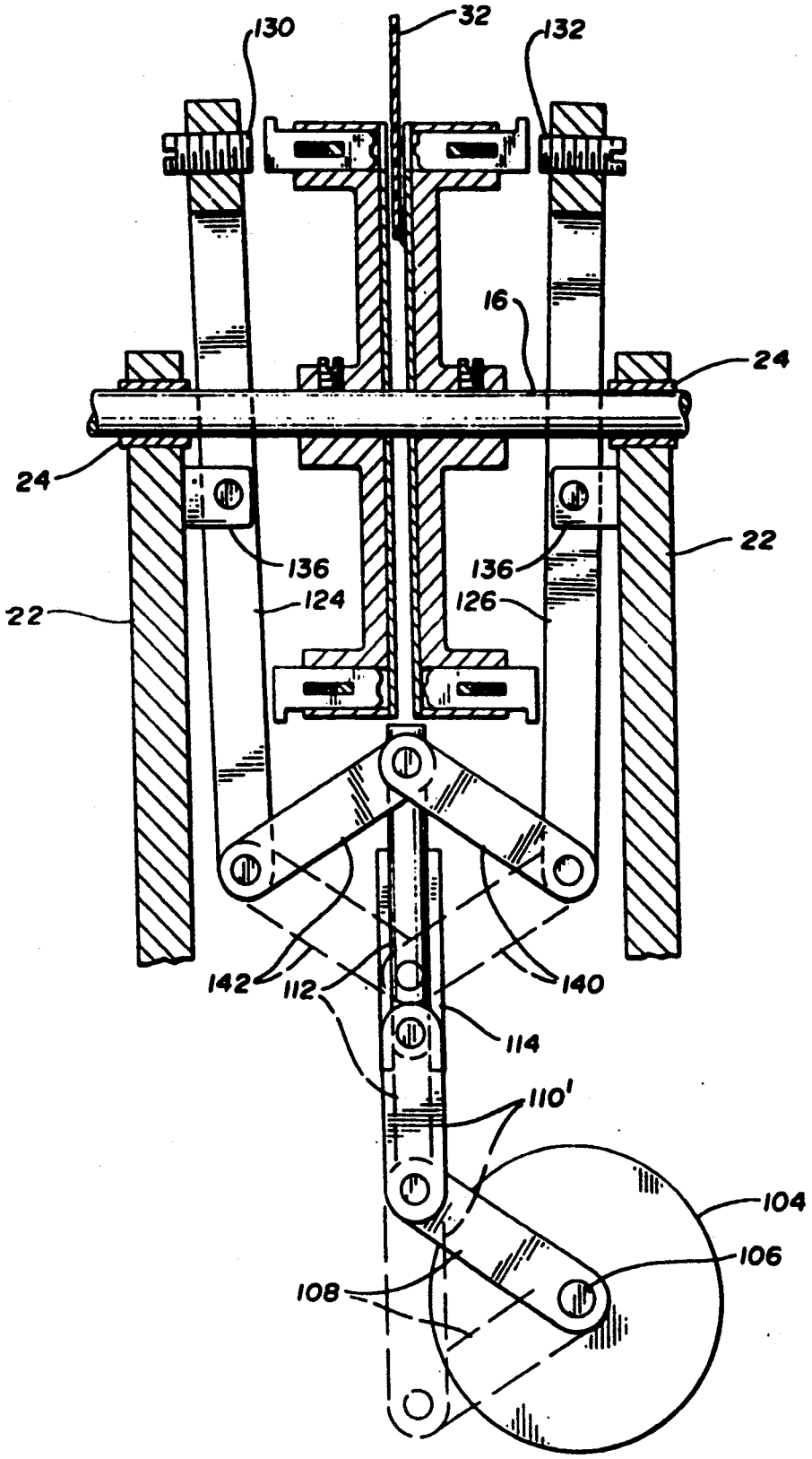
FIG. 10 is a sectional view of a still further embodiment of the embossing mechanism with the section taken in the same manner as in FIG. 9.

FIG. 10 also illustrates an embossing mechanism where a single solenoid is used to provide the embossing force for both the punch and die members. As distinguished, however, from the embodiment shown in FIG. 9, the embodiment shown in FIG. 10 utilizes a rotary solenoid 104 which drives a shaft 106 which is in turn, connected to a link 108 which is pivotally connected to one end of a connecting link 110', the other end of which is pivotally connected to a sliding shaft 112 which is restrained for movement along an axis perpendicular to that of shaft 16. The link 108 and the link 110' cooperating to form a crank arm. Further links 140 and 142 are pivotally connected to sliding shaft 112 which is restrained from movement other than along the axis of track 114. As shaft 106 and link 108 are rotated from the position shown in solid line in FIG. 10 to the position shown in dashed line, sliding shaft 112 and links 140 and 142 attached thereto are moved from the solid line position to the dashed line position illustrated and further links 124 and 126 pivot such that adjusting screws 130 and 132 engage print elements 26 and 28 and emboss a character on card 32. As was the case with the rotary embosser embodiment shown in FIGS. 8 and 9, the embodiment in FIG. 10 can be operated either in a double-acting mode utilizing separate coils to drive the rotary solenoid to and from each of the two operating positions or, alternatively, the solenoid can be single-acting with a return spring returning the mechanism to an initial position after a character is embossed and the printwheel is rotated to move print elements 26 and 28 out of line with the adjusting screws 130 and 132 at the ends of links 124 and 126.

Figure 11:
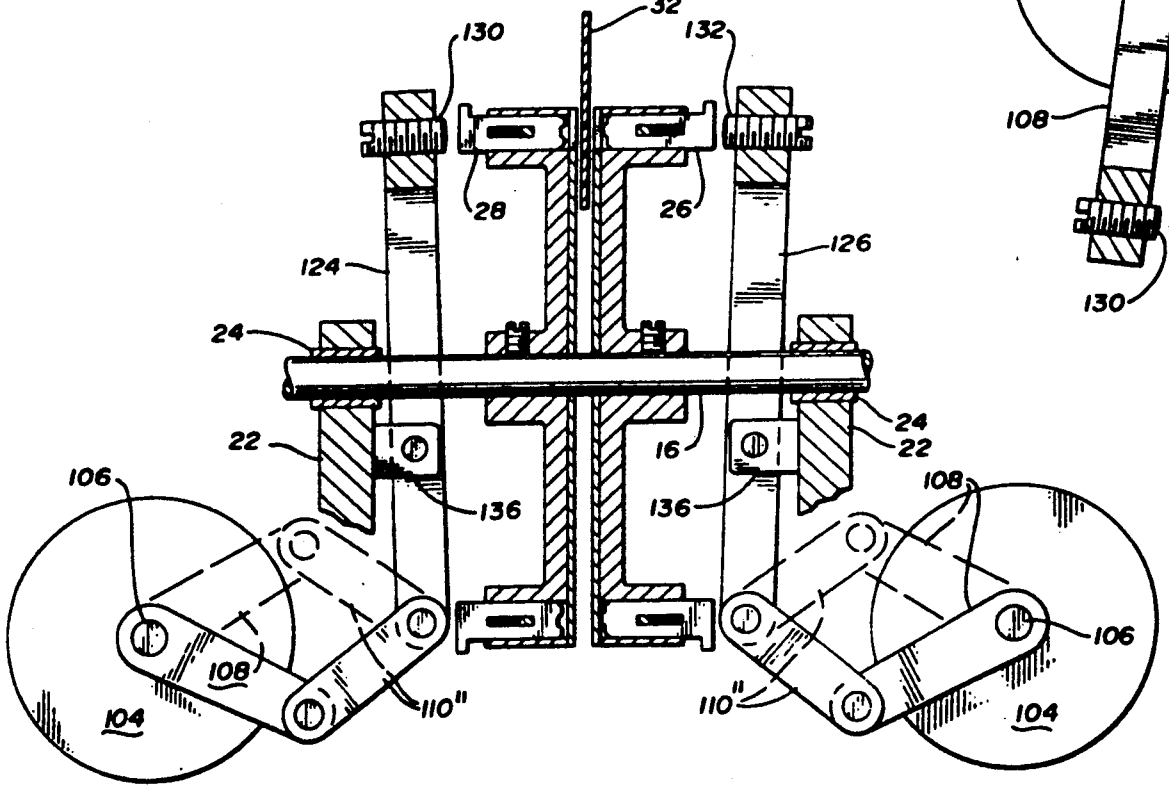
FIG. 11 is a sectional view of an additional embodiment of the embossing mechanism with the section taken in the same manner as in FIG. 9.

FIG. 11 is an additional embodiment of the embossing mechanism utilizing a pair of rotary solenoids 104 which couple their rotary action to drive forces applied to type elements 26 and 28 utilizing links 124 and 126. Each of the rotary solenoids 104 drives shaft 106 which is rigidly connected to one end of link 108, the other end of which is pivotally connected to one end of link 110'', the other end of which is pivotally connected to the end of link 124 or 126 which is opposite to the end to which adjusting screw 130 or 132 is attached. As was the case with the other rotary solenoid embodiments, solenoid 104 can either be single or double acting.

Figure 12:
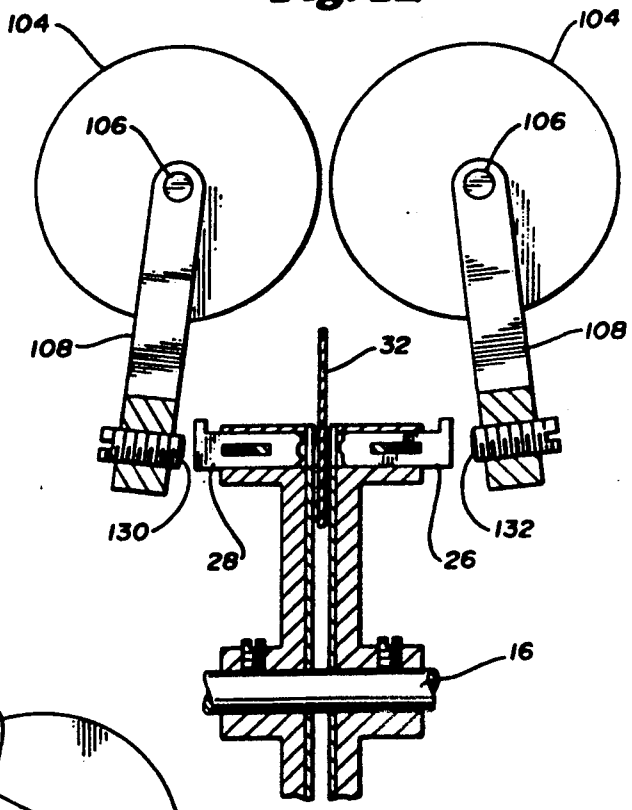
FIG. 12 is a sectional view of a further alternative embodiment of the embossing mechanism with the section taken in the same manner as in FIG. 9.

FIG. 12 shows a simplified rotary solenoid linkage where rotary solenoids 104 drive shafts 106 which are directly connected to one end of link 108, the other end of which carries adjusting screws 130 and 132. Solenoids 104 are actuated to rotate shaft 106 and link 108 to apply direct embossing force to punch and die elements 26 and 28 to adjusting screws 130 and 132. These solenoids can either be double-acting to return them to the initial position or can be biased to return to their initial position using spring force after the actuating energy is removed.

For each of the embossing embodiments shown, it can also be seen that it is not necessary to have punch and die elements installed in wheels 12 and 14 in all applications. In some applications, it will be found that a punch and anvil set is the desired combination to carry out embossing operations with a carbon release paper positioned between the punch type elements and the card to print a character into the surface of the card while the reverse side of the card is supported by the movable anvil element having a flat surface. The solenoid embossing mechanism according to the present invention provides superior results in that application as well as the other applications illustrated.

It will be seen that the preferred and alternative embodiments of the present invention as described herein are not the only forms in which the present invention provides superior results. Other linkage arrangements can be utilized without departing from the scope of the invention which is limited only by the following claims:

What is claimed is:

1. In apparatus for embossing sheet material with characters including a plurality of cooperating print elements inserted in slots positioned about the circumference of cooperating print wheels rotatable in coordination with each other on a frame to permit positioning of a pair of print elements with one element on each side of sheet material positioned in an embossing area; an improved embossing force applying mechanism comprising, in combination:

(a) a solenoid mounted on the frame, the solenoid having a shaft and being constructed and arranged when energized for effecting movement of the shaft from a first position to a second position whose position is sensed by monitoring the current;

(b) linkage means coupled to the shaft of the solenoid constructed and arranged for imparting motion, along the embossing axis, to a print element of a pair of print elements, the print elements being disposed in axial alignment in the embossing area; and (c) solenoid driver means for selectively applying energy to the solenoid to move the shaft between the first and second positions, during which the sheet material is embossed with a permanently deformed selected character, the driver means including means for energizing the solenoid in two stages, the first of which energizes the solenoid to bring the linkage means into contact with the print element and moves the print element into close proximity with the sheet material which is the first position and the second of which energizes the solenoid to apply embossing force to the print element continuously during movement of the print element from the first position to the second position thereby permanently deforming the sheet material and reducing the noise of the imprinting operation, the force applied by the solenoid to the print element in the second stage being greater than the force applied by the solenoid to the print element in the first stage, the print element moving slower in the second stage than the first stage, the second stage lasting longer than the first stage, the driver means accessing prestored character information to determine the amount of embossing force to be applied during the second stage when embossing a selected character whereby all characters are embossed a substantially uniform amount.

2. The invention of claim 1 wherein the solenoid includes at least one winding and one restraining spring means and the solenoid driver means includes means for actuating the winding to move the shaft in one direction from one of the first and second positions to the other of the first and second positions and the restraining spring means is coupled for returning the shaft to the original of the first and second positions.

3. The invention of claim 1 wherein the linkage means also includes mechanical means for engaging the type element for retracting it into the printwheel at the conclusion of a character embossing step when the solenoid returns to the first position and ceases to apply embossing force and a restraining spring returns the linkage means and the solenoid shaft to the starting position.

4. The invention of claim 1 wherein both of the print elements are driven by the solenoid.

5. The invention of claim 1 where one of the cooperating print elements is driven by the solenoid and the other is moved by the action of cam means positioned adjacent the embossing area and adapted for moving only those print elements in the vicinity of the embossing area from the printwheels for engagement with the solenoid driven print element.

6. The invention of claim 1 wherein the linkage means also includes retractor means adapted for movement with the shaft for engaging the print element after an embossing operation to return the print element to the printwheels.

7. The invention of claim 1 wherein the linkage means includes slidably supported drive pin means aligned with the embossing axis and having one end thereof adjacent the print element, the linkage means constructed and arranged for coupling movement of the shaft of the solenoid to the print element.

8. The invention of claim 7 wherein the linkage means is constructed and arranged for allowing the shaft of the solenoid to initially move independently of the drive pin means and for impacting the drive pin means to transfer kinetic energy from the shaft of the solenoid to the drive pin means.

9. The invention of claim 1 wherein the solenoid is a linear solenoid mounted beneath the printwheels having its shaft movable between the first and second positions along an axis perpendicular to and intersecting the rotational axes of the printwheels and wherein the linkage means includes a beam pivotally mounted on the frame, a first end of the beam constructed and arranged for engaging one of the printing elements, the other end of the beam being coupled to the shaft of the solenoid means by a link constructed and arranged for causing the first end of the beam to apply embossing force to the printing element when the shaft moves between the first and second positions.

10. The invention of claim 9 wherein the linkage means includes beams for coupling movement of the solenoid shaft to the printing elements of both printwheels.

11. The invention of claim 1 wherein the solenoid is a rotary solenoid mounted beneath the printwheels and having a crank arm coupled at one end to the shaft and pivotally coupled at the other end to a slidable member constrained from movement along an axis perpendicular to the shaft and wherein the linkage means includes a beam pivotally mounted on the frame, a first end of the beam constructed and arranged for engaging one of the printing elements, the other end of the beam being coupled to the slidable member by a link constructed and arranged for causing the first end of the beam to apply embossing force to the print element when the shaft of the rotary solenoid moves from a first to a second rotational position.

12. The invention of claim 1 wherein the solenoid includes at least one rotary solenoid mounted beneath the printwheels, the shaft is movable between first and second rotational positions, the linkage means includes a beam pivotally mounted on the frame, a first end of the beam being constructed and arranged for engaging one of the print elements, the other end of the beam being coupled to the shaft of the rotary solenoid by a link constructed and arranged for causing the first end of the beam to apply embossing force to the print element when the shaft moves between the first and second rotational positions.

13. The invention of claim 1 wherein the solenoid comprises at least one rotary solenoid mounted on the frame adjacent the printwheels, the linkage means having a crank arm coupled at one end to the shaft positioned such that the other end engages the print elements to apply an embossing force thereto when the rotary solenoid is moved from a first rotational position to a second rotational position.

14. The invention of claim 1, wherein the solenoid includes a linear solenoid for effecting linear movement of its shaft from a first to a second position.

15. The invention of claim 1, wherein the solenoid includes a rotary solenoid for effecting rotary movement to its shaft from a first to a second position.

16. The invention of claim 1, having only a single solenoid.

17. The invention of claim 1, wherein the shaft of the solenoid is aligned with an axis of linear movement of the pair of print elements.

18. In apparatus for embossing sheet material with characters including a plurality of cooperating print elements inserted in a slots positioned about the circumference of cooperating print wheels rotatable in coordination with each other on a frame to permit positioning of a pair of print elements with one element on each side of sheet material positioned in an embossing area; an improved embossing force applying mechanism comprising, in combination:

(a) solenoid mounted on the frame, the solenoid having a shaft and being constructed and arranged when energized for effecting movement of the shaft from a first position to a second position whose position is sensed by monitoring the current;

(b) linkage means coupled to the shaft of the solenoid constructed and arranged for imparting motion, along the embossing axis, to an element of a pair of print elements, the print elements being disposed in axial alignment in the embossing area;

(c) solenoid drive means for selectively applying energy to the solenoid to move the shaft between the first and second positions, during which the sheet material is embossed with a permanently deformed selected character, the driver means including means for applying voltage to the solenoid in two stages, the first of which energizes the solenoid to bring the linkage means into contact with the print element and move the print element into close proximity with the sheet material which is the first position and the second of which energizes the solenoid to apply embossing force to the print element continuously during movement of the print element from the first position to the second position thereby permanently deforming the sheet material and reducing the noise of the embossing operation; and (d) wherein the solenoid includes a rotary solenoid mounted beneath the printwheels and having a crank arm coupled at one end of the shaft and pivotally coupled at the other end to a slidable member constrained from movement along an axis perpendicular to the shaft wherein the linkage means includes a beam pivotally mounted on the frame, a first end of the beam constructed and arranged for engaging one of the print elements the other end of the beam being coupled to the slidable member by a link constructed and arranged for causing the first end of the beam to apply embossing pressure to the print element when the shaft of the rotary solenoid moves from a first to a second rotational position, the drive means accessing prestored character information to determine the amount of embossing force to be applied during the second stage when embossing a selected characters whereby all characters are embossed a substantially uniform amount.

19. The invention of claim 1 wherein the velocity of the shaft of the solenoid slows down substantially between the first and second stages.

20. In apparatus for embossing sheet material with characters including a plurality of cooperating print elements inserted in slots positioned about the circumference of cooperating print wheels rotatable in coordination with each other on a frame to permit positioning of a pair of print elements with one element on each side of sheet material positioned in an embossing area; an improved embossing pressure applying mechanism comprising, in combination:

(a) a solenoid mounted on the frame, the solenoid having a shaft and being constructed and arranged when energized to effectuate movement of the shaft from a first position to a second position whose position is sensed by monitoring the current;

(b) linkage means coupled to the shaft of the solenoid constructed and arranged for imparting motion, along the embossing axis, to an element of a pair of print elements, the print elements being disposed in axial alignment in the embossing area; and (c) solenoid drive means for selectively applying energy to the solenoid to move the shaft of the solenoid between the first and second positions, during which the sheet material is embossed with a permanently deformed selected character, the solenoid driver means including means for energizing the solenoid in two stages, the first of which energizes the solenoid to bring the linkage means into contact with the print element and moves the print element into close proximity with the sheet material which is the first position and the second stage of which energizes the solenoid to apply embossing force to the print element continuously during movement of the print element from the first position to the second position thereby permanently deforming the sheet material, the force applied by the solenoid to the print element in the second stage being greater than the force applied by the solenoid to the print element in the first stage, the print element moving slower in the second stage than the first stage, the second stage lasting longer than the first stage, the driver means accessing prestored character information to determine the amount of embossing force to be applied during the second stage when embossing a selected character whereby all characters are embossed a substantially uniform amount.

21. The invention of claim 1, wherein the first and second stages are separated by a predetermined time interval.

22. An apparatus for embossing sheet material with characters including a plurality of print elements, comprising:

(a) a solenoid having a shaft and being constructed and arranged when energized for effecting movement of the shaft from a first position to a second position whose position is sensed by monitoring the current;

(b) linkage means coupled to the shaft of the solenoid for imparting motion to a print element as the shaft moves from the first to the second positions; and (c) solenoid driver means for selectively applying energy to the solenoid to move the shaft between the first and second positions, during which the sheet material is embossed with a permanently deformed selected character, the solenoid drive means including means for energizing the solenoid in two stages, a first stage of which causes movement of the print element into close proximity with the sheet material which is the first position, and a second stage of which applies an embossing force to the print element continuously during movement of the print element from the first position to the second position, the printer element moving slower in the second stage than the first stage, the second stage lasting longer than the first stage, the driver means accessing prestored character information to determine the amount of embossing force to be applied during the second stage when embossing a selected character whereby all characters are embossed a substantially uniform amount.

23. A method for embossing sheet material by use of print elements and at lest one solenoid, the method comprising the steps of:

(a) positioning a selected print element in alignment with a surface area of the sheet material to be embossed with the selected print element; and (b) energizing the solenoid, including first energizing the solenoid to cause movement of the selected print element into close proximity with the sheet material to be embossed which is a first position and secondly energizing the solenoid to apply an embossing force to the selected print element continuously during movement of the print element to a second position whose position is sensed by monitoring the current, the print element being moved slower and longer during the second energization whereby embossing of the sheet material is accomplished by prestored character information being accessed to determine the amount of embossing force to be applied when embossing a selected character whereby all characters are embossed a substantially uniform amount.

* * * * *